US010781637B1

(12) United States Patent
Hall

(10) Patent No.: US 10,781,637 B1
(45) Date of Patent: Sep. 22, 2020

(54) IN-GROUND CONTAINER INSTALLATION APPARATUSES AND AUGER BLADE ASSEMBLIES

(71) Applicant: Eric Lee Hall, DeRiddler, LA (US)

(72) Inventor: Eric Lee Hall, DeRiddler, LA (US)

( * ) Notice: Subject to any disclaimer, the term of this patent is extended or adjusted under 35 U.S.C. 154(b) by 31 days.

(21) Appl. No.: 16/180,933

(22) Filed: Nov. 5, 2018

(51) Int. Cl.
*E21B 10/44* (2006.01)
*E21B 7/02* (2006.01)
*E21B 10/26* (2006.01)

(52) U.S. Cl.
CPC ..... *E21B 7/028* (2013.01); *E21B 10/26* (2013.01); *E21B 10/44* (2013.01)

(58) Field of Classification Search
CPC ..... E21B 7/028; E21B 10/44
USPC ..... 175/385
See application file for complete search history.

(56) References Cited

U.S. PATENT DOCUMENTS 2,385,441 A * 9/1945 Hill ..... A01B 1/00 172/25
2,975,848 A 3/1961 Roberts
4,212,358 A * 7/1980 Wisbrock ..... E21B 7/028 173/195
4,323,019 A 4/1982 Haddock
4,672,901 A 6/1987 Stine
4,923,165 A 5/1990 Cockman
6,089,334 A * 7/2000 Watts ..... E21B 10/44 175/170
6,125,776 A 10/2000 Carmichael
6,296,068 B1 * 10/2001 Frederick ..... A01C 5/04 111/116
6,725,950 B2 4/2004 Palm
9,161,487 B1 * 10/2015 Provines ..... A01B 33/06
9,661,806 B2 5/2017 Rushing
9,686,921 B2 6/2017 Baron
2003/0146021 A1 * 8/2003 Palm ..... E21B 7/028 175/57
2004/0256123 A1 * 12/2004 Lea ..... A01C 5/02 172/371
2012/0318577 A1 12/2012 Ruppel et al.
2018/0160616 A1 6/2018 Mihara
2019/0250072 A1 * 8/2019 Pasch ..... E21B 49/02

* cited by examiner

*Primary Examiner* — Taras P Bemko
(74) *Attorney, Agent, or Firm* — R. Keith Harrison

(57) ABSTRACT

In-ground container installation apparatuses may include a housing support frame. An apparatus housing having a housing interior may be resiliently carried by the housing support frame in a plumb and pendulum configuration. The housing support frame may be mounted for axial displacement between a mixing position and a digging position with respect to the apparatus housing when the apparatus housing is in a stationary position. A drive motor may be provided on the housing support frame. An auger blade assembly may be drivingly engaged for rotation by the drive motor. The auger blade assembly may be disposed in the housing interior in the mixing position of the housing support frame and extend from the apparatus housing in the digging position of the housing support frame. Auger blade assemblies for driving engagement by a drive motor of an in-ground container installation apparatus are also disclosed.

16 Claims, 17 Drawing Sheets

IN-GROUND CONTAINER INSTALLATION APPARATUSES AND AUGER BLADE ASSEMBLIES

FIELD

Illustrative embodiments of the disclosure are generally directed to apparatus suitable for forming holes in soil for the installation of soil containers for vegetation. More particularly, illustrative embodiments of the disclosure relate to in-ground container installation apparatuses which are suitable to facilitate expeditious formation of holes in soil and mixing of soil components for the installation of soil containers and planting of vegetation and/or to prevent scatter or spillage of soil outside edges of augered holes to aid or facilitate soil removal from a hole or area.

SUMMARY

Illustrative embodiments of the disclosure are generally directed to in-ground container installation apparatuses suitable to facilitate expeditious formation of holes in soil and mixing of soil components for the installation of soil containers and planting of vegetation. In some embodiments, the in-ground container installation apparatuses may include a housing support frame. An apparatus housing having a housing interior may be resiliently carried by the housing support frame in a plumb and pendulum configuration, or may hang or suspend in a plumb bob state of pendulum. The housing support frame may be mounted for axial displacement between a mixing position and a digging position with respect to the apparatus housing when the apparatus housing is in a stationary position. A drive motor may be provided on the housing support frame. An auger blade assembly may be drivingly engaged for rotation by the drive motor. The auger blade assembly may be disposed in the housing interior in the mixing position of the housing support frame and extend from the apparatus housing in the digging position of the housing support frame. The drive motor may travel along a vertical axis to facilitate augering of depths in soil while traveling through the housing interior to guide the auger blade assembly into and out of the soil.

Illustrative embodiments of the disclosure are further generally directed to auger blade assemblies for driving engagement by a drive motor of an in-ground container installation apparatus. In some embodiments, the auger blade assemblies may include an elongated blade drive shaft drivingly engaged for rotation by the drive motor. An auger blade flighting may extend from the blade drive shaft. The auger blade flighting may have a blade edge. An extra length pilot extension may extend from the blade drive shaft distal to the auger blade flighting.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
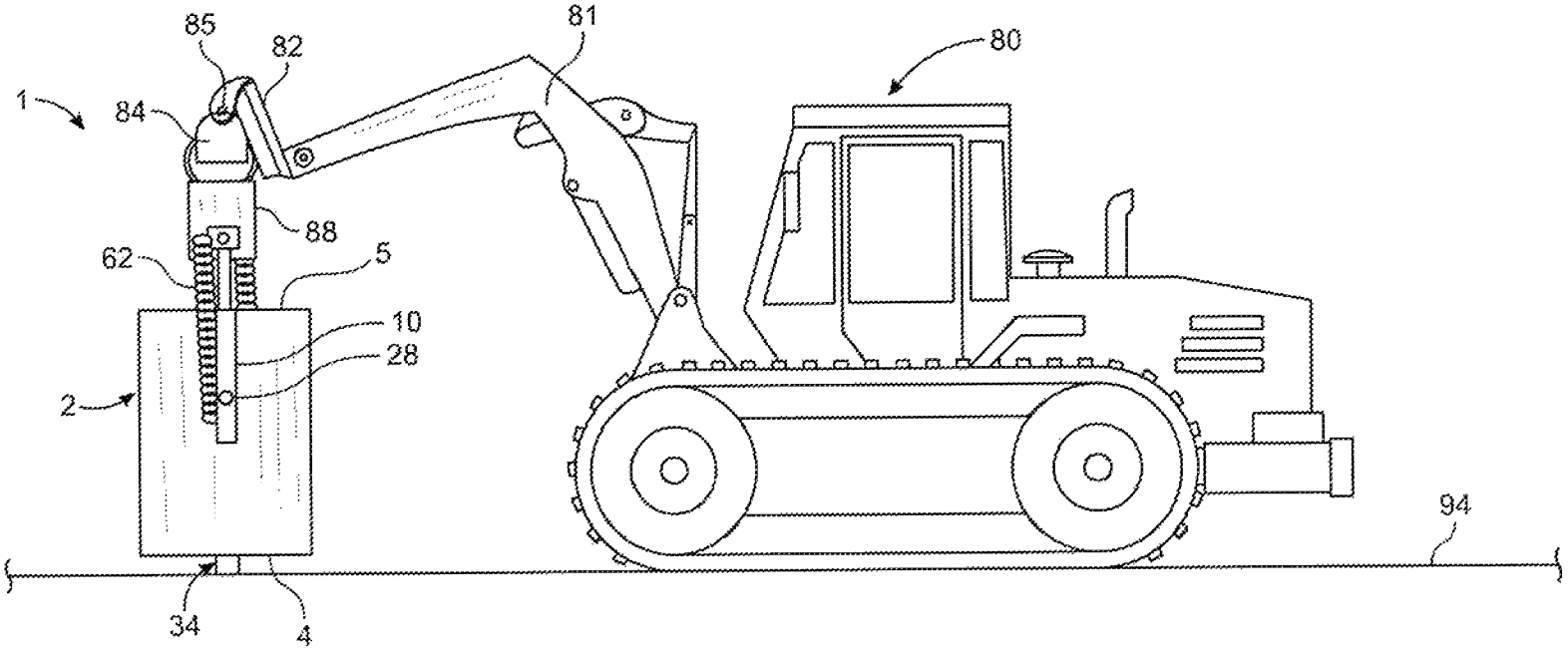
FIG. 1 is a side view of an illustrative embodiment of the in-ground container installation apparatuses, mounted on a front-end loader in typical application of the apparatuses.

Referring initially to FIGS. 1 and 13-22 of the drawings, an illustrative embodiment of the in-ground container installation apparatuses, hereinafter apparatus, is generally indicated by reference numeral 1. As will be hereinafter described, the apparatus 1 may be suitable for mounting on a front-end loader or other utility vehicle 80, typically having a skid steer mount plate 82, to facilitate expeditious formation of a hole 95 (FIGS. 15-22) in the ground 94 typically for the purpose of installing a soil container 76 (FIG. 17) for the planting of trees 98 (FIG. 22) or other vegetation in the holes 95. The apparatus 1 may additionally be suitable for mixing soil 96 (FIGS. 20-22) removed from the holes 95 with soil amendments 92 (FIG. 20) prior to backfilling or placement of the soil 96 back into the holes 95 for planting. The apparatus 1 may facilitate formation of a large number of the holes 95 in the ground 94, installation of the soil containers 76 in the holes 95 and mixing of the soil 96 with soil amendments 92 in each hole 95 in a fraction of the time and with a fraction of the manpower which can be achieved using shovels and other manual digging equipment and personnel. As illustrated in FIG. 1, the utility vehicle 80 may have a conventional design with a pair of loader arms 81 and a skid steer mounting plate 82 extending between the loader arms 81.

Figure 6:
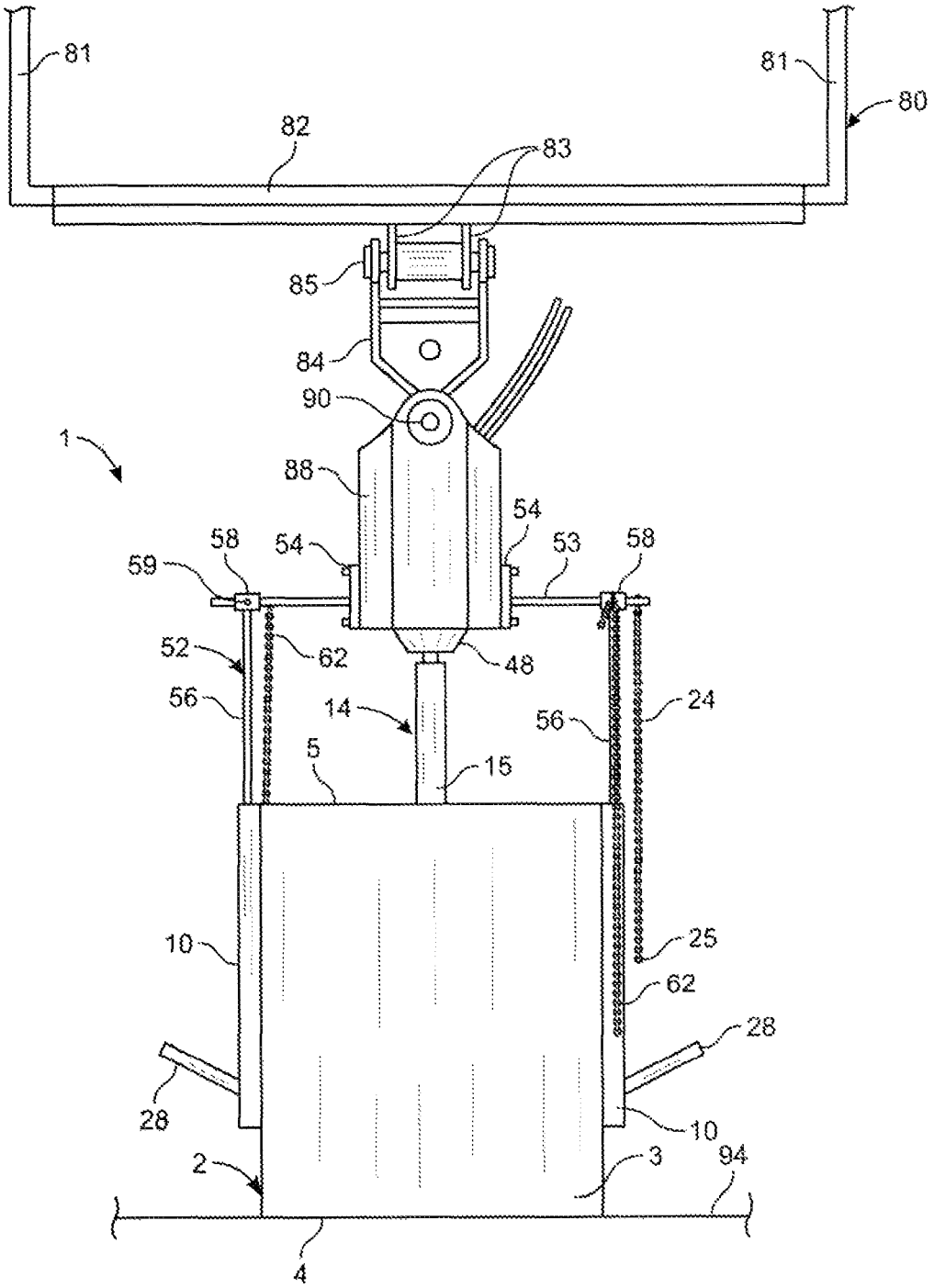
FIG. 6 is a front view of an illustrative in-ground container installation apparatus, mounted on a front-end loader (partially in section), with the housing support frame of the apparatus disposed in a raised mixing position with respect to the apparatus housing and the apparatus housing deployed in a lowermost position on the housing support frame.
Figure 7:
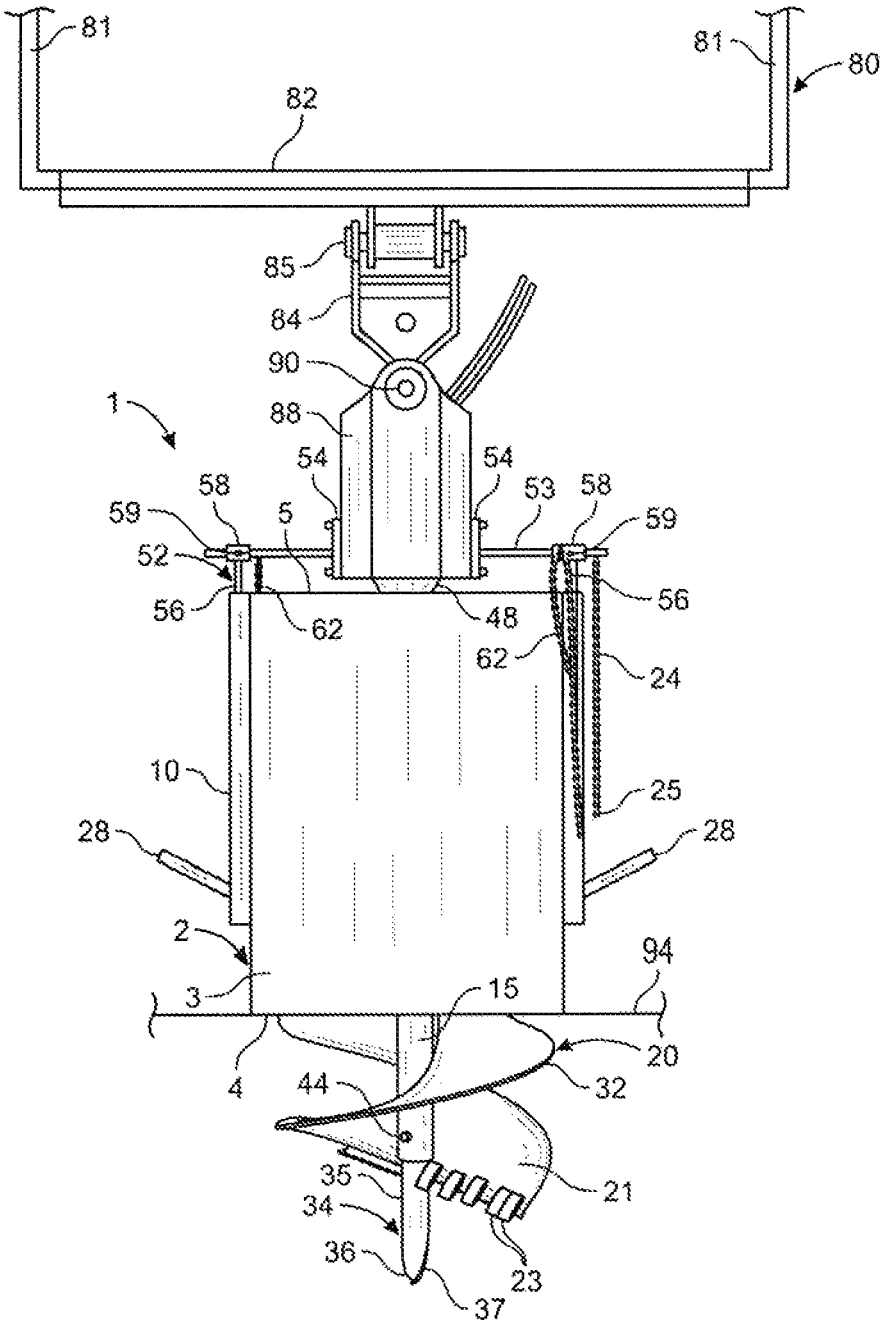
FIG. 7 is a front view of an illustrative in-ground container installation apparatus, mounted on the front-end loader, with the housing support frame of the apparatus disposed in a lowered digging position with respect to the apparatus housing and the apparatus housing deployed in an uppermost position on the housing support frame.
Figure 8:
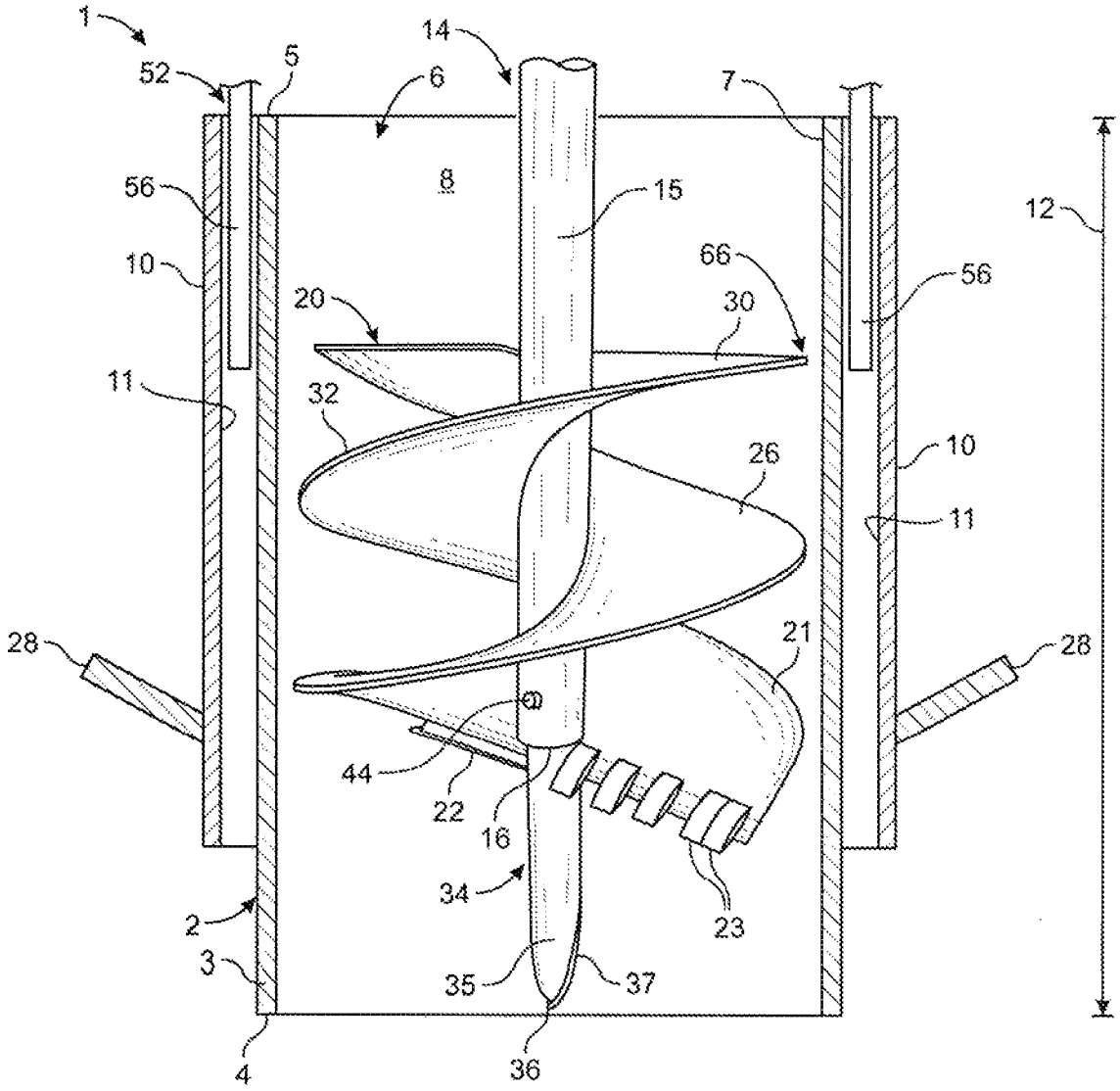
FIG. 8 is a longitudinal sectional view of the apparatus housing with the auger blade assembly disposed in the mixing position in the housing interior of the apparatus housing.
Figure 9:
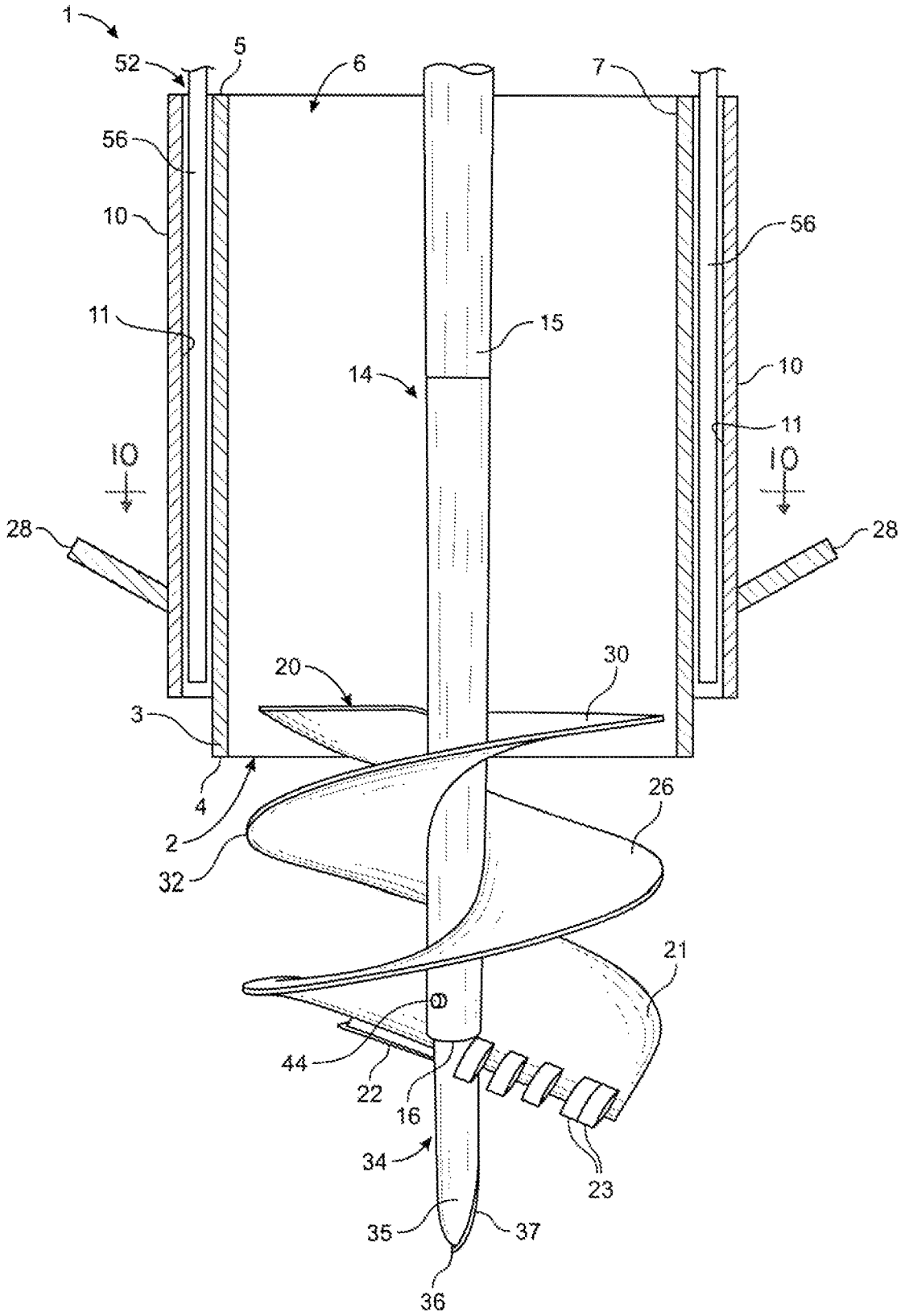
FIG. 9 is a longitudinal sectional view of the apparatus housing with the auger blade assembly disposed in the digging position with respect to the apparatus housing.

Referring next to FIGS. 2-12 of the drawings, the apparatus 1 may include a housing support frame 52. As illustrated in FIGS. 6 and 7, the housing support frame 52 may be mounted on the skid steer mounting plate 82 of the utility vehicle 80 typically in a manner which will be hereinafter described. An apparatus housing 2 may be mounted on the housing support frame 52. The apparatus housing 2 may be resiliently mounted with respect to the housing support frame 2 in a plumb or pendulum state or configuration and in such a manner that the housing support frame 52 is vertically or axially displaceable between a raised mixing position (FIG. 6) and a lowered digging position (FIG. 7) with respect to the apparatus housing 2 when the apparatus housing 2 is in a stationary position engaging the ground 94. A drive motor 88 may be provided on the housing support frame 52. In some embodiments, the drive motor 88 may be a slower speed higher torque hydraulic motor known by those skilled in the art. In other embodiments, the drive motor 88 may be gas- or electric-powered and may have other capacities. In alternative embodiments, the drive motor 88 may utilize a planetary drive, a chain drive or other drive mechanism known by those skilled in the art. An auger blade assembly 14 may be drivingly engaged for rotation by the drive motor 88. As illustrated in FIG. 8, in the mixing position of the housing support frame 52, the auger blade assembly 14 may be disposed in the housing interior 6 of the apparatus 2. As illustrated in FIG. 9, in the digging position of the housing support frame 52, the auger blade assembly 14 may extend from the housing interior 6 of the apparatus housing 2.

The housing support frame 52 may have any design which is suitable for the purpose of resiliently supporting the apparatus housing 2 thereon. As illustrated in FIGS. 6 and 7, in some embodiments, the housing support frame 52 may include an elongated main frame member 53. The drive motor 88 may be mounted on the main frame member 53 using welding, brackets, clamps, mechanical fasteners and/or other suitable techniques known by those skilled in the art. As illustrated in FIGS. 6 and 7, in some embodiments, the main frame member 53 may include a pair of main frame member segments (not numbered) which may be attached to opposite sides of the drive motor 88 such as by using respective frame brackets 54. At least one frame arm 56 may extend from the main frame member 53 typically in perpendicular relationship thereto. In some embodiments, a pair of elongated frame arms 56 may extend from the main frame member 53 in parallel, spaced-apart relationship to each other, as illustrated. A pair of arm collars 58 may be adjustably mounted on the housing support frame 52 and selectively securable thereon according to the knowledge of those skilled in the art. Each frame arm 56 may extend from each corresponding arm collar 58. Accordingly, the arm collars 58 may be slid along the main frame member 53 and secured in place to position the frame arms 56 at a desired spacing with respect to each other for purposes which will be hereinafter described. In some embodiments, a collar pin opening 59 may be provided in each arm collar 58. A collar securing bolt (not illustrated) may be threaded through the collar pin opening 59 and tightened against the main frame member 53 to secure the corresponding arm collar 58 to secure the arm collar 58 at a selected position along the length of the main frame member 53.

As illustrated in FIGS. 8 and 9, in some embodiments, the apparatus housing 2 may have a housing wall 3 which may be elongated and cylindrical. The housing wall 3 may have a distal wall end 4 which is farther from the drive motor 88 (FIG. 6) and a proximal wall end 5 which is closer to the drive motor 88. A housing interior 6 may extend from the distal wall end 4 to the proximal wall end 5. The housing wall 3 of the apparatus housing 2 may have an interior wall surface 7 which faces the housing interior 6. As illustrated in FIG. 8, in some embodiments, the housing wall 3 of the apparatus housing 2 may have a housing height or length 12 of from about 30" to about 40", and optimally, about 36" for purposes which will be hereinafter described. In other embodiments, the housing wall 3 may be any height.

The apparatus housing 2 may be resiliently mounted on the housing support frame 52 using any suitable technique which is known by those skilled in the art and suitable for the purpose. In some embodiments, at least one arm receptacle 10 having a receptacle interior 11 may be provided on the housing wall 3 of the apparatus housing 2. Each arm receptacle 10 may telescopically receive the corresponding frame arm 56 of the housing support frame 52. Accordingly, in the mixing position of the housing support frame 52, as illustrated in FIGS. 6 and 8, the frame arms 56 may extend from the respective arm receptacles 10. As the housing support frame 52 is lowered from the mixing position to the digging position, illustrated in FIGS. 7 and 9, the frame arms 56 may retract into the respective arm receptacles 10. In some embodiments, each arm receptacle 10 may include square tubing, for example and without limitation, which may be welded, fastened, or fabricated in one piece with the housing wall 3 according to the knowledge of those skilled in the art.

As illustrated in FIGS. 6 and 7, in some embodiments, at least one housing suspension member 62 may attach the apparatus housing 2 to the housing support frame 52. In some embodiments, each of a pair of housing suspension members 62 may be attached to each arm collar 58 and each corresponding frame arm 56 using welding, mechanical fasteners and/or other suitable technique known by those skilled in the art. Each housing suspension member 62 may include a chain, as illustrated, or may alternatively include a cord or strip of rubber, fabric and/or other flexible material. As illustrated in FIGS. 6 and 7, in some embodiments, the housing suspension members 62 may be attached to the respective arm collars 58 and arm receptacles 10 on opposite sides of the apparatus housing 2 for weight-balancing purposes.

The drive motor 88 may be mounted in a plumb or pendulum state or configuration on the skid steer mounting plate 82 of the utility vehicle 80 according to any suitable technique which is known by those skilled in the art. As further illustrated in FIGS. 6 and 7, in some embodiments, a pair of spaced-apart plate flanges 83 may extend from the skid steer mounting plate 82. An apparatus mount bracket 84 may be pivotally mounted on the plate flanges 83 via a fore/aft pivot pin 85. A lateral pivot pin 90 may pivotally mount the drive motor 88 to the apparatus mount bracket 84. Accordingly, the fore/aft pivot pin 85 may facilitate forward and rearward pivoting of the drive motor 88 on the skid steer mounting plate 82, whereas the lateral pivot pin 90 may facilitate lateral or side-to-side pivoting of the drive motor 88 on the apparatus frame 82.

Figure 10:
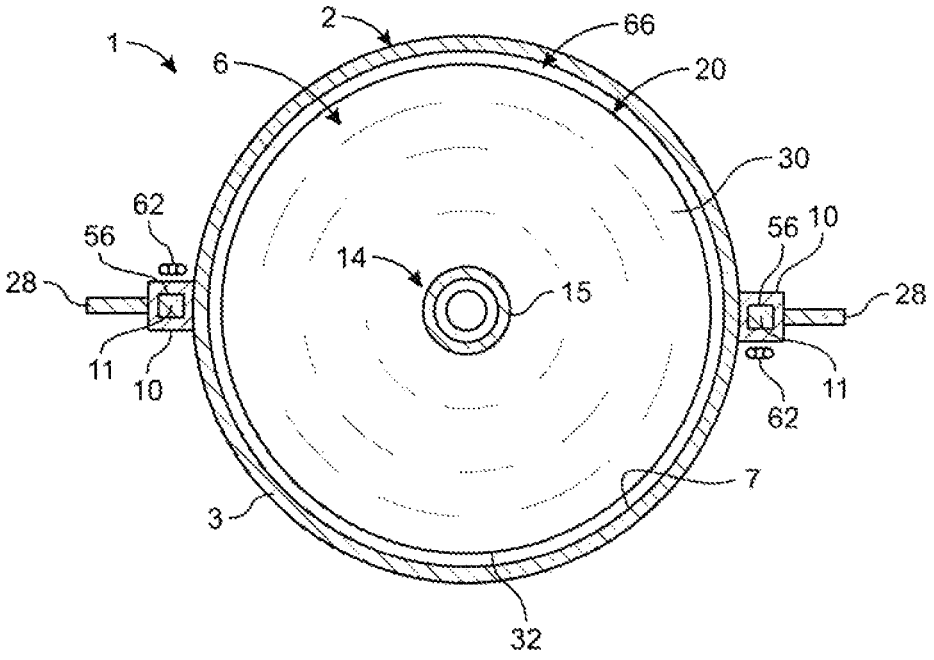
FIG. 10 is a cross-sectional view, taken along section lines 10-10 in FIG. 9, of the apparatus housing an auger blade assembly in the apparatus housing.
Figure 11:
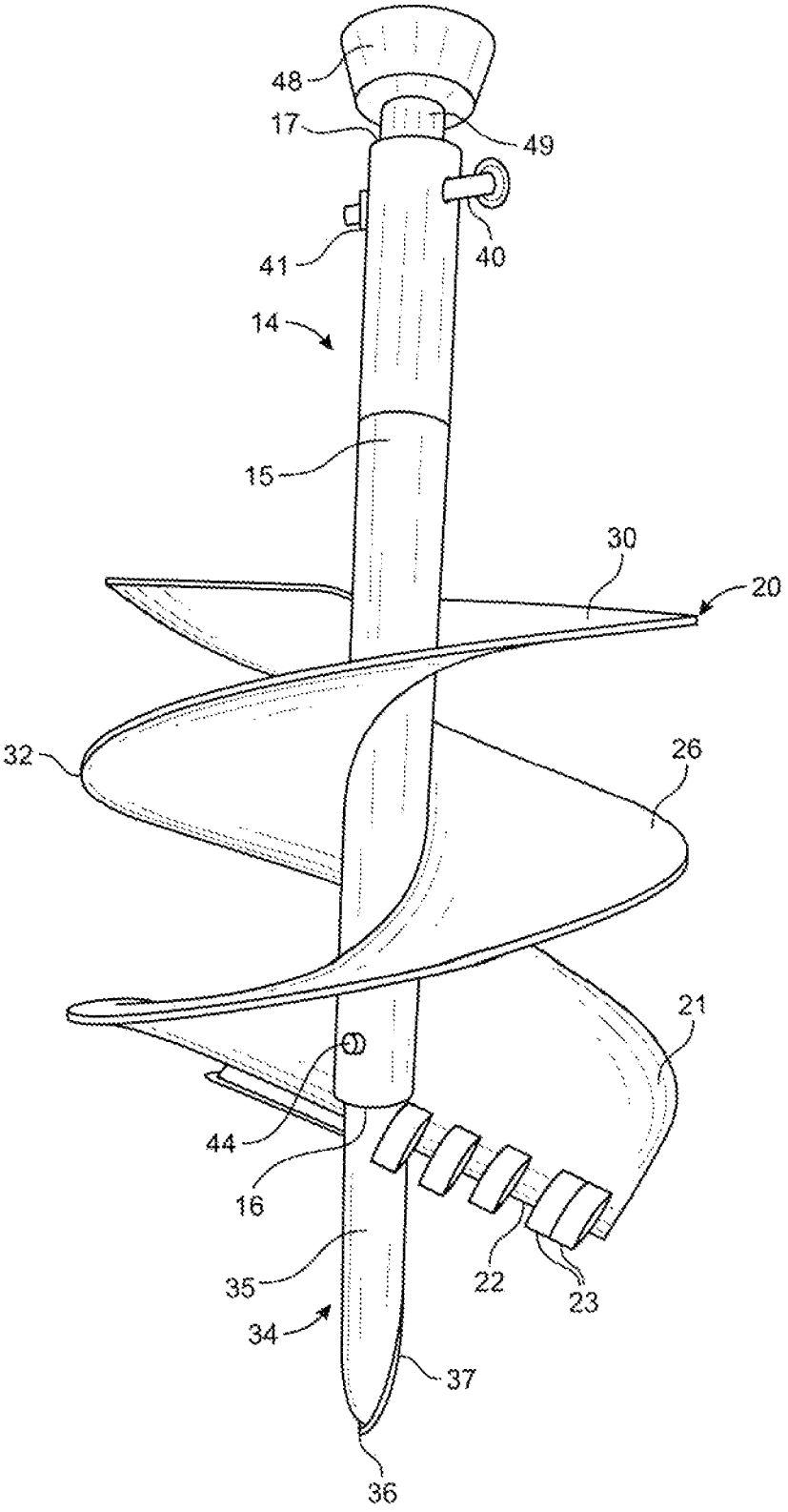
FIG. 11 is a front view of a typical auger blade assembly suitable for implementation of the in-ground container installation apparatuses.
Figure 12:
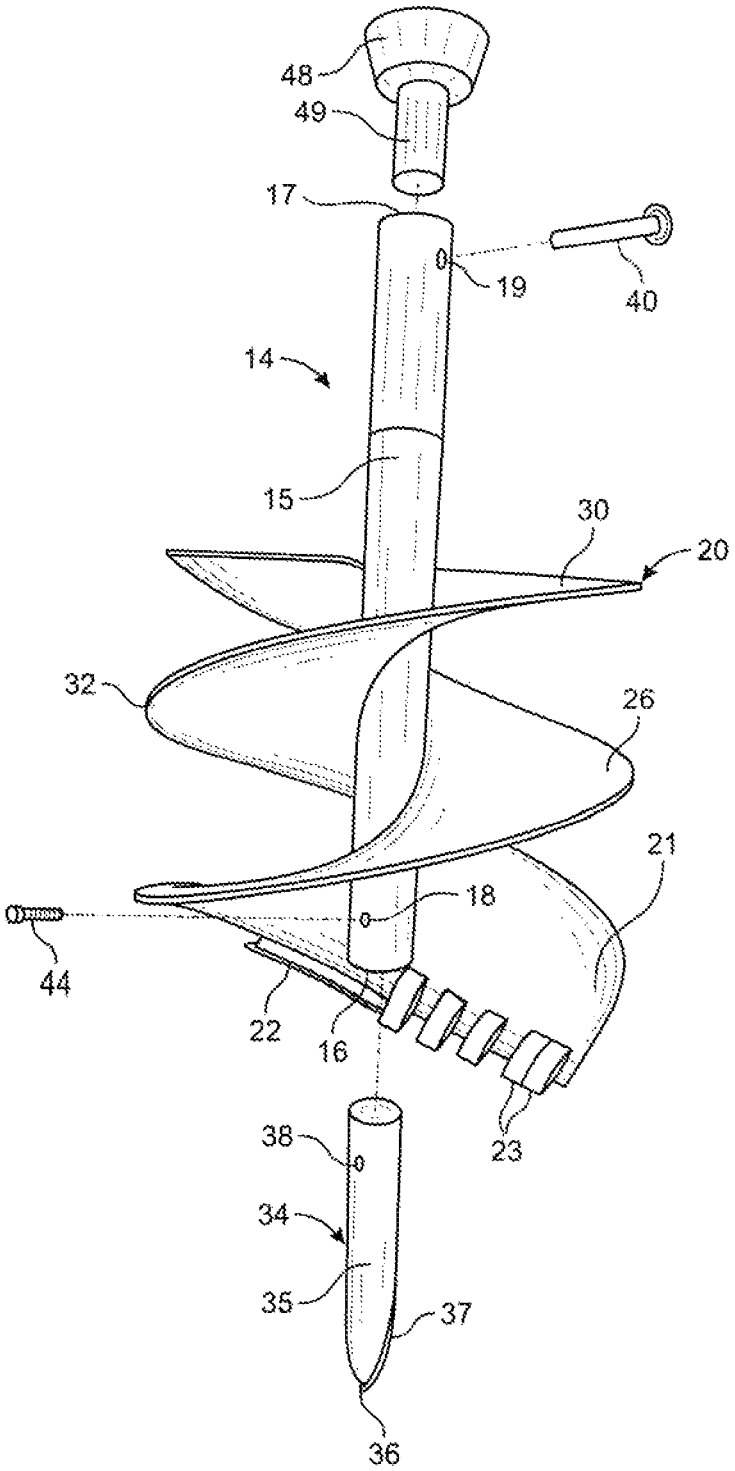
FIG. 12 is an exploded front perspective view of the auger blade assembly.

As illustrated in FIGS. 8-12, the auger blade assembly 14 may include an elongated blade drive shaft 15. As illustrated in FIGS. 11 and 12, the blade drive shaft 15 may have a distal shaft end 16 and a proximal shaft end 17. An auger blade flighting 20 may extend outwardly from the blade drive shaft 15 between the distal shaft end 16 and the proximal shaft end 17. In some embodiments, the auger blade flighting 20 may include 3-3.5 (optimal) auger blade wraps on the blade drive shaft 15, although in some embodiments, the auger blade flighting 20 may include less than 3 or greater than 3.5 auger blade wraps, depending typically on the height of the apparatus housing 2. Accordingly, the auger blade flighting 20 may include a distal flighting blade portion 21 which is proximate the distal shaft end 16 and farthest from the drive motor 88, a middle flighting blade portion 26 which extends from the distal flighting blade portion 21 toward the proximal shaft end 17 and a proximal flighting blade portion 30 which extends from the middle flighting blade portion 26 and is proximate the proximal shaft end 17 and closest to the drive motor 88. A cutting edge 22 may extend along the leading edge of the distal flighting blade portion 21.

In some embodiments, a plurality of cutting teeth 23 may be provided along the cutting edge 22. As illustrated in FIGS. 8-10, the auger blade flighting 20 may have an outer blade edge 32. As illustrated in FIG. 10, in some embodiments, a blade clearance space 66 may be defined between the outer blade edge 32 of the auger blade flighting 20 and the interior wall surface 7 of the housing wall 3. In some embodiments, the blade clearance space 66 may be between 3/16" (0.1875 in.) and ½" (0.5 in.) in width for purposes which will be hereinafter described. To achieve a uniform blade clearance space 66 throughout the length of the auger blade flighting 20, the distal flighting blade portion 21, the middle flighting blade portion 26 and the proximal flighting blade portion 30 may have a uniform width or diameter. As illustrated in FIG. 8, in the mixing position of the housing support frame 52, the housing interior 6 may include a fill volume 8 between the proximal flighting blade portion 30 of the auger blade flighting 20 and the proximal wall end 5 of the housing wall 3 of the application housing 2 for purposes which will be hereinafter described.

As further illustrated in FIGS. 11 and 12, in some embodiments, the auger blade assembly 14 may further include a pilot extension 34 which extends from the distal shaft end 16 of the blade drive shaft 15 distally beyond the distal flighting blade portion 21 of the auger blade flighting 20. The pilot extension 34 may include an elongated pilot extension shaft 35 which extends from the blade drive shaft 15, a pointed pilot extension tip 36 terminating the pilot extension shaft 35 and at least one pilot extension blade 37 extending from the blade drive shaft 35 and typically terminating at the pilot extension tip 36. In some embodiments, the pilot extension shaft 35 may be mechanically coupled and/or welded to the blade drive shaft 15 according to the knowledge of those skilled in the art, such as by inserting the pilot extension shaft 35 in the distal shaft end 16 and extending a pilot extension bolt 44 through a pilot extension bolt opening 18 in the blade drive shaft 15 and through a registering shaft bolt opening 38 in the pilot extension shaft 35, as illustrated in FIG. 12. In some embodiments, a securing nut (not illustrated) may be threaded and tightened on the pilot extension bolt 44. In alternative embodiments, the pilot extension shaft 35 may be fabricated in one piece with the blade drive shaft 15 according to the knowledge of those skilled in the art. In some embodiments, the pilot extension 34 may have a length of from about 8 inches to about 16 inches. This length of the pilot extension 34 may prevent or substantially minimize "walking" of the auger blade assembly 14 and malformation of the hole 95 in the ground 94 in typical operation of the apparatus 1.

Figure 2:
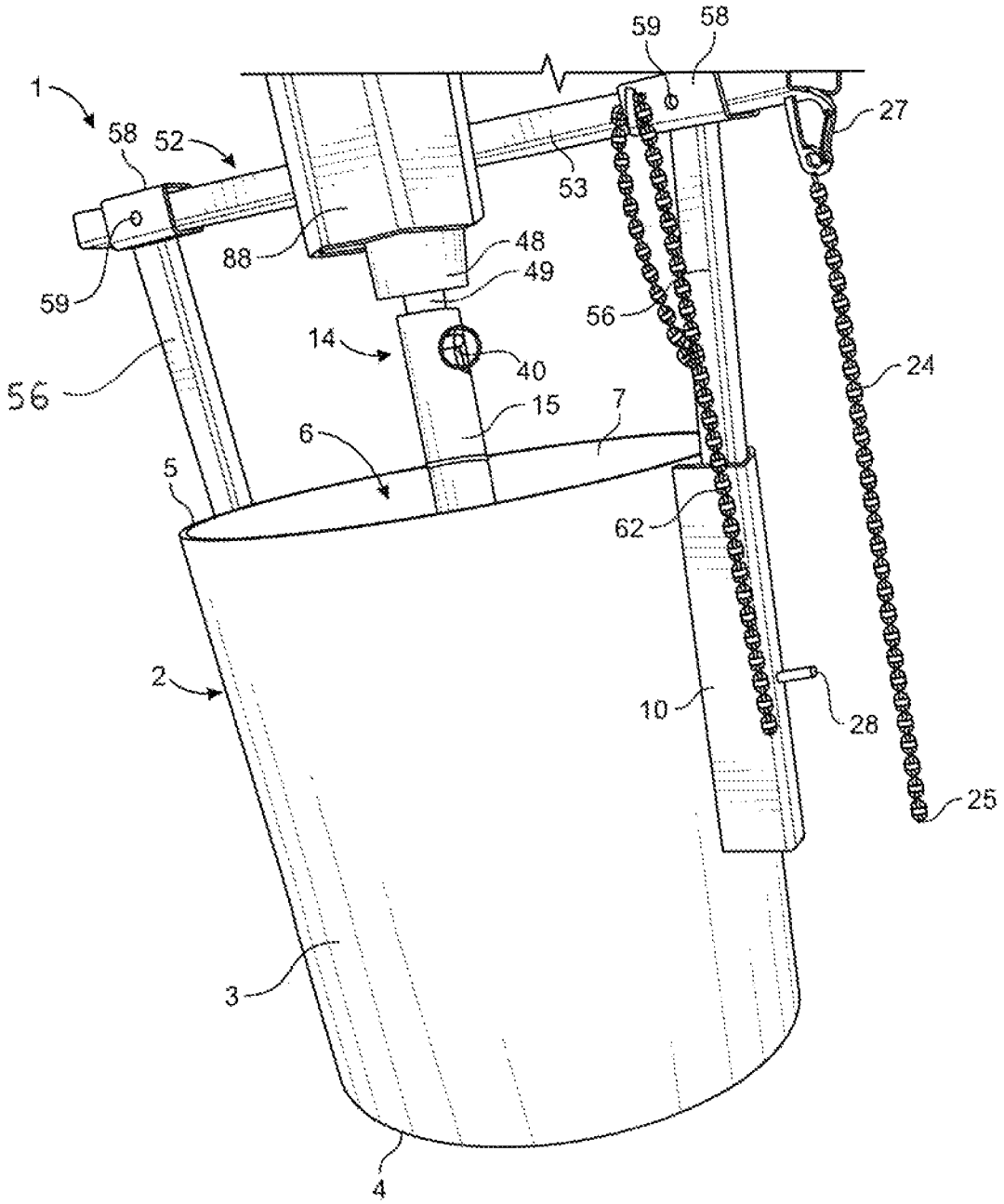
FIG. 2 is a front perspective view of an illustrative in-ground container installation apparatus.
Figure 3:
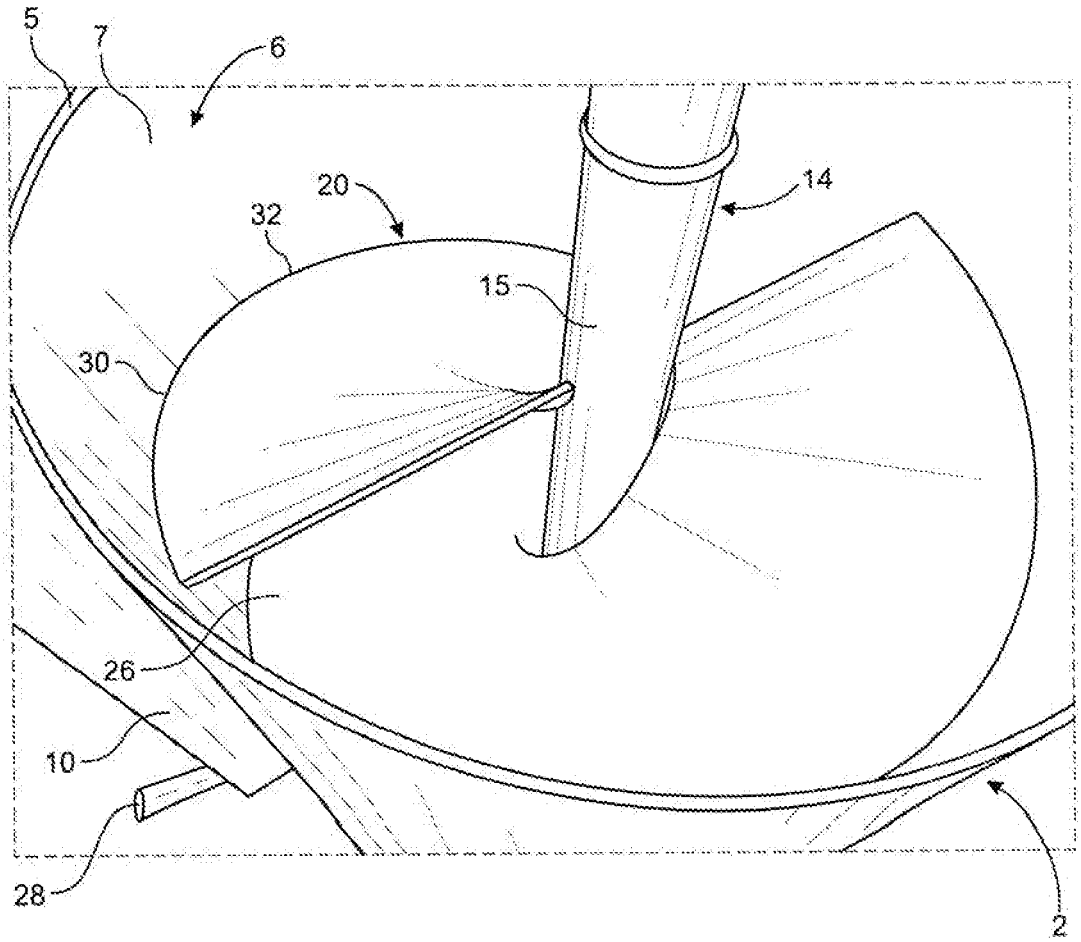
FIG. 3 is an enlarged top perspective view of the housing interior of the apparatus housing with a typical auger blade assembly disposed in the housing interior.

The auger blade assembly 14 may be drivingly coupled for rotation by the drive motor 88 according to any suitable technique which is known by those skilled in the art. As illustrated in FIGS. 11 and 12, in some embodiments, a drive head 48 having a drive head shaft 49 may be drivingly engaged by the drive motor 88 (FIG. 2). As illustrated in FIG. 12, the blade drive shaft 15 of the auger blade assembly 14 may be drivingly coupled to the drive head 48 such as by inserting the drive head shaft 49 into the open proximal shaft end 17 of the blade drive shaft 15 and inserting a blade drive shaft bolt or pin 40 through a shaft bolt opening 19 in the blade drive shaft 15 and threading a securing nut 41 on the shaft bolt or pin 40. In alternative embodiments, the blade drive shaft 15 may be fabricated in one piece with the drive head 48 according to the knowledge of those skilled in the art.

As illustrated in FIG. 2, in some embodiments, a depth gauge 24 typically having a depth gauge terminus 25 may be suspended from the main frame member 53 of the housing support frame 52. In typical application of the apparatus 1, which will be hereinafter described, the depth gauge 24 may descend with the housing support frame 52 from the raised mixing position to the lowered digging position. Accordingly, the position of the depth gauge terminus 25 with respect to the apparatus housing 2 may be used to measure or estimate the depth of each hole 95 as the hole 95 is formed in the ground 94. In some embodiments, depth markings (not illustrated) may be provided on the exterior surface of the housing wall 3. Accordingly, the depth gauge terminus 25 on the depth gauge 24 may register with the depth markings to indicate the current depth of the hole 95 as the hole 95 is being formed in the ground 94.

Figure 4:
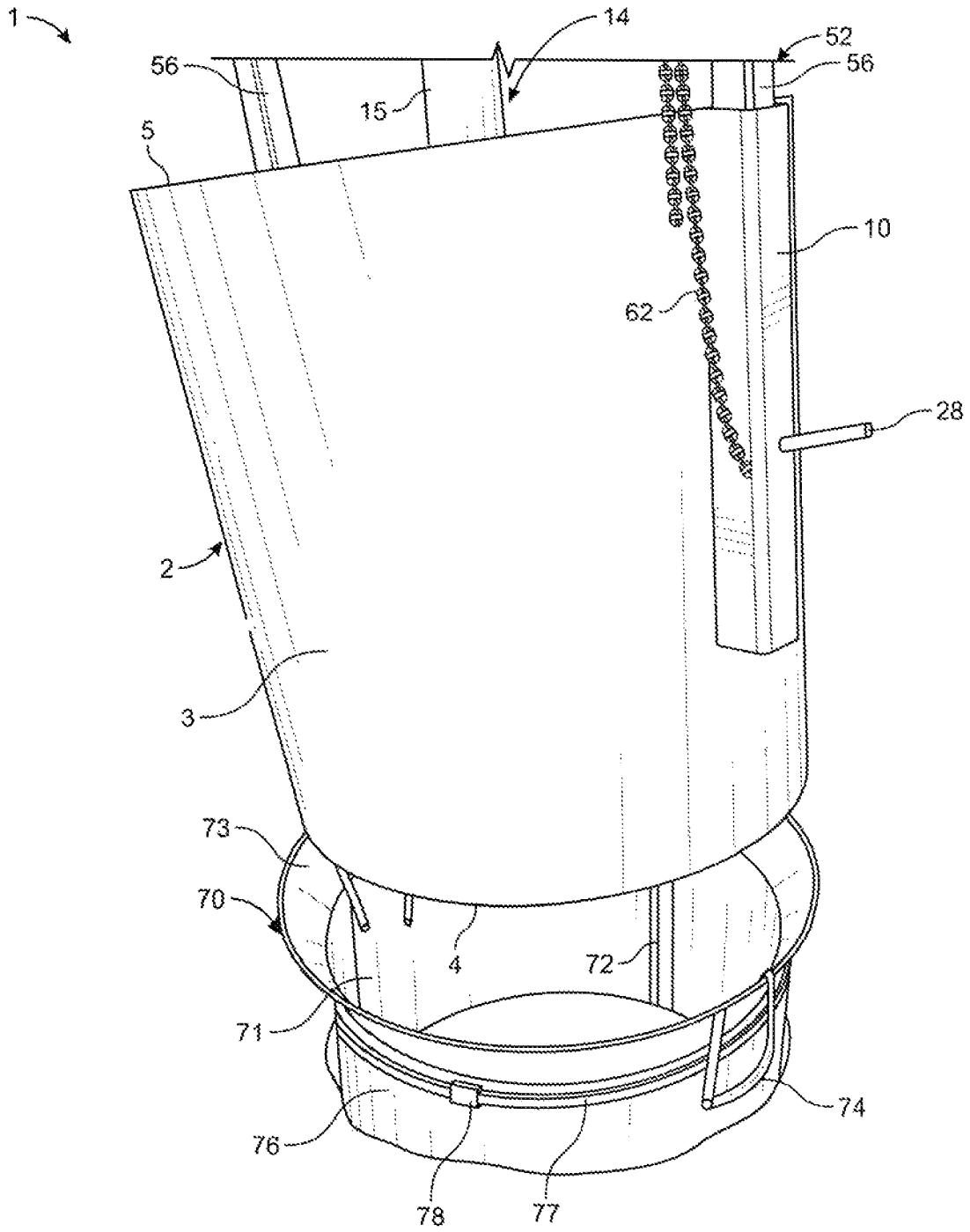
FIG. 4 is an exploded front perspective view of the apparatus housing preparatory to deployment of the apparatus housing into a container sleeve (partially in section) in typical application of the in-ground container installation apparatuses.
Figure 5:
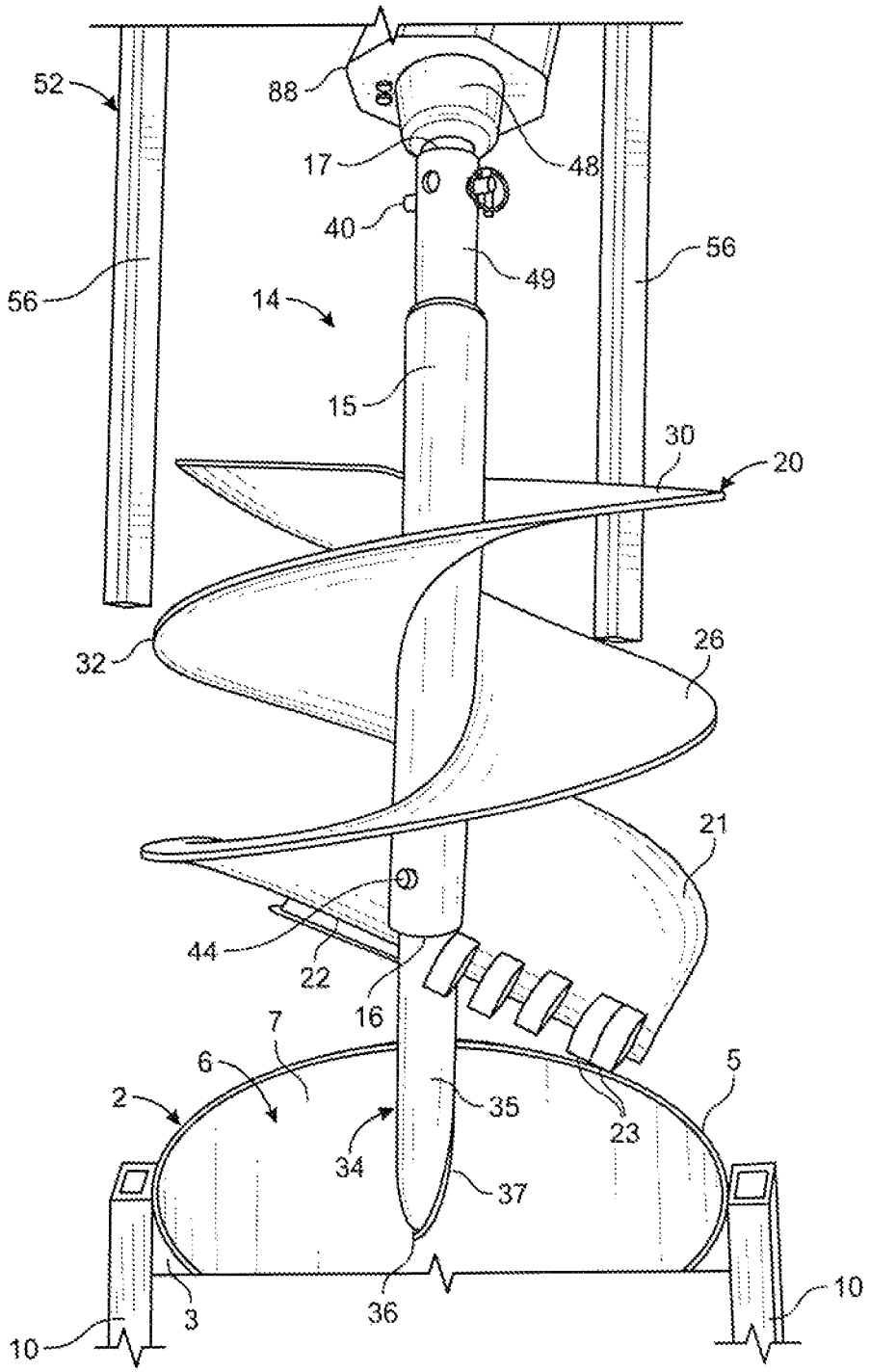
FIG. 5 is a front perspective view of a typical auger blade assembly suitable for implementation of the in-ground container installation apparatuses, more particularly illustrating a drive motor drivingly engaging the auger blade assembly for rotation and the auger blade assembly raised from the housing interior of the apparatus housing.

In typical application, which will be hereinafter described, the apparatus 1 may be used in conjunction with a container sleeve 70 and a soil container 76 (FIG. 17) to facilitate expeditious planting of vegetation 98 such as a tree, for example and without limitation, in the ground 94. As illustrated in FIG. 4, in some embodiments, the container sleeve 70 may include a container sleeve wall 71 which may be generally cylindrical. A typically annular container sleeve flange 73 may extend outwardly from an edge of the container sleeve wall 71. In some embodiments, the container sleeve wall 71 may be generally conical and may taper inwardly from the container sleeve flange 73 to a lower wall edge 75 (FIG. 17) of the container sleeve wall 71. A container sleeve slot 72 may interrupt the container sleeve wall 71 and the container sleeve flange 73. In some embodiments, a pair of container sleeve handles 74 (one of which is illustrated) may be attached to the interior surfaces at opposite sides of the container sleeve wall 71. In some embodiments, the container sleeve wall 71 may be fabricated of fiberglass. In other embodiments, the container sleeve wall 71 may be fabricated of other flexible and durable material. As further illustrated in FIG. 4, in some embodiments, the opposite ends of a cam buckle strap 77 may be attached to the container sleeve wall 71 using hooks, brackets, clamps, clips, mechanical fasteners and/or other attachment technique (not illustrated). The cam buckle strap 77 may extend across the container sleeve slot 72. A cam buckle 78, which may be standard or conventional in design, may engage the cam buckle strap 77. Accordingly, the cam buckle 78 may be selectively operated in a forward direction to reduce the length of the cam buckle strap 77 and facilitate a selected overlap between the edges of the container sleeve wall 71 at the container sleeve slot 72 in order to selectively reduce the diameter or width of the container sleeve wall 71. The cam buckle 78 may be selectively operated in a reverse direction to lengthen the cam buckle strap 77 as the container sleeve wall 71 recoils and enlarges in diameter approaching the container sleeve slot 72.

The soil container 76 may be suitably sized and configured to accommodate the container sleeve wall 71 of the container sleeve 70. In some embodiments, the soil container 76 may be fabricated of a biodegradable fabric material, polypropylene and/or other polymeric material known by those skilled in the art.

Figure 13:
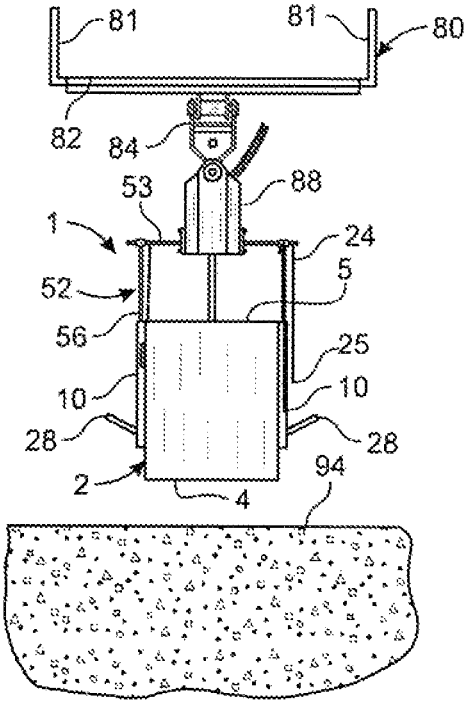
FIGS. 13-22 illustrate sequential steps in a typical method of installing an in-ground soil container using the in-ground container installation apparatus.
Figure 20:
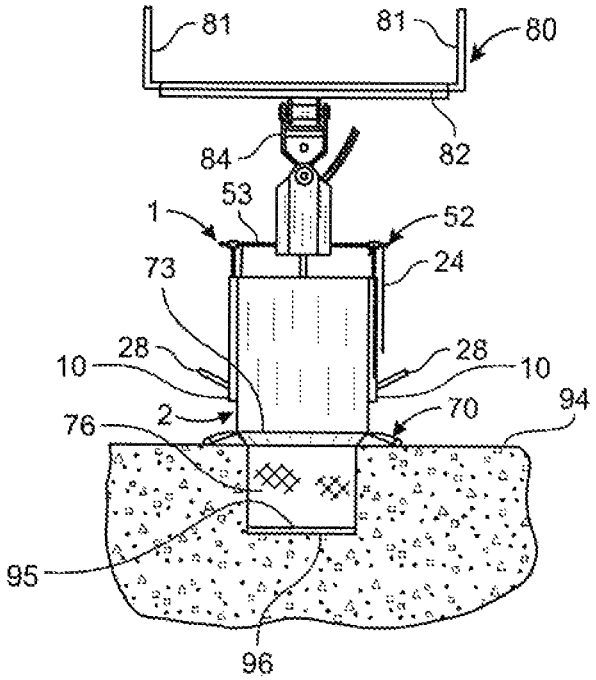
Figure 21:
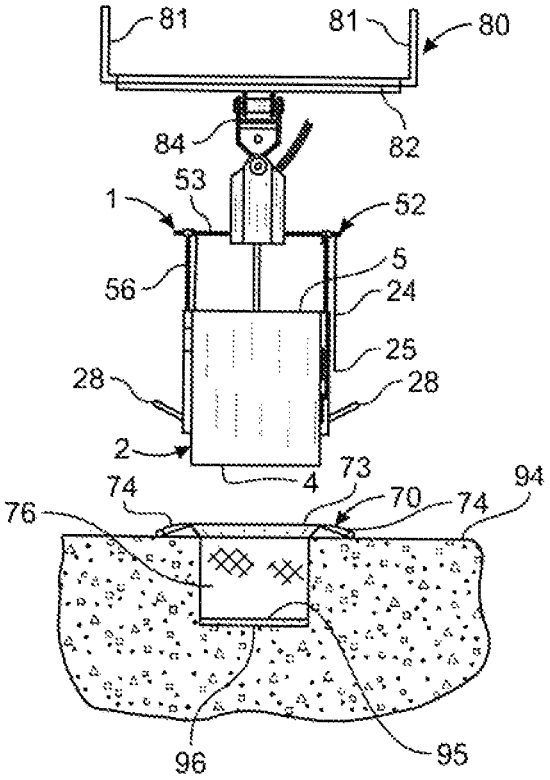
Figure 22:
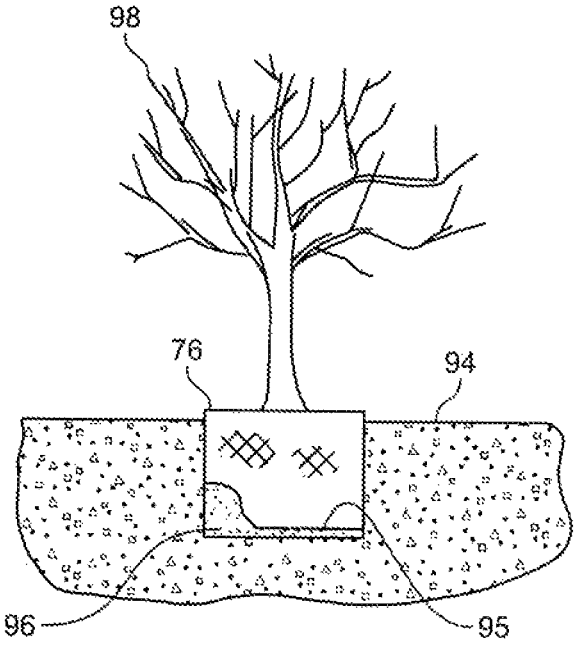

Referring next to FIGS. 13-22, in typical application, the apparatus 1 may be used to form a hole 95 (FIGS. 15-22) in the ground 94 such as for the purpose of planting a tree or other vegetation 98 in the ground 94, as illustrated in FIG. 22. Alternatively, the apparatus 1 may be used to remove soil from a site, such as to replace the soil with other material, for example and without limitation. Accordingly, as illustrated in FIG. 13, the utility vehicle 80 may initially be operated to raise and position the apparatus 1 over the area of the ground 94 in which the hole 95 will be made typically by operation of the loader arms 81. Thus, the housing support frame 52 may be deployed in the mixing position with the apparatus housing 2 suspended in the lowermost position on the frame arms 56 by gravity and the auger blade assembly 14 disposed inside the housing interior 6, as was heretofore described with respect to FIG. 8.

Figure 14:
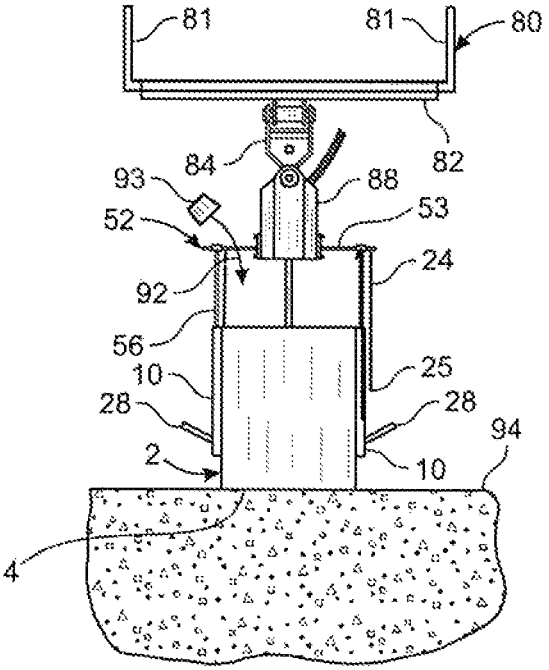
Figure 15:
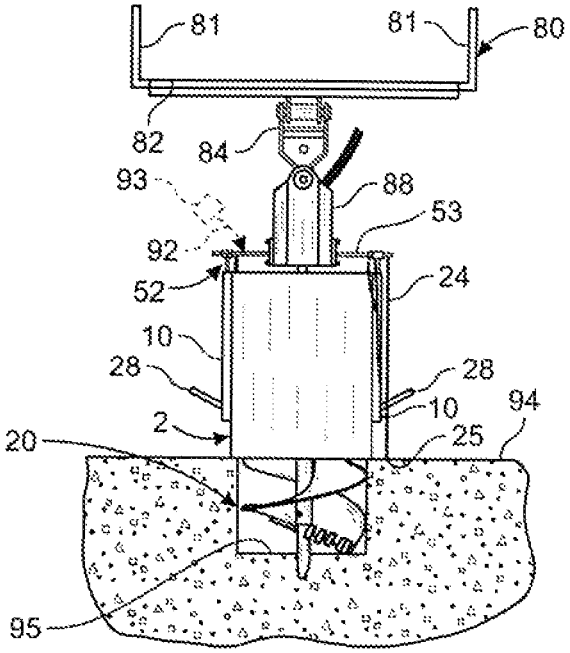

As illustrated in FIG. 14, the loader arms 81 of the utility vehicle 80 may next be operated to lower the apparatus housing 2 onto the surface of the ground 94. As the distal wall end 4 of the apparatus housing 2 contacts the ground 94, the housing support frame 52 may initially be deployed in the mixing position with the apparatus housing 2 still deployed at the lowermost position on the frame arms 56 of the housing support frame 52, as illustrated in FIG. 14. The loader arms 81 of the utility vehicle 80 may continue to be lowered as the housing support frame 52 is lowered from the mixing position to the digging position as the frame arms 56 of the housing support frame 52 insert into the respective arm receptacles 10 on the apparatus housing 2 and the pilot extension 34 and auger blade flighting 20 of the auger blade assembly 14 progressively extend from the housing interior 6 beyond the distal wall end 4 of the housing wall 3. Simultaneously, the drive motor 88 may be operated to rotate the auger blade assembly 14 in the housing interior 6 of the apparatus housing 2, as illustrated in FIG. 15. Accordingly, the pilot extension 34 may initially penetrate the surface of the ground 94, after which the auger blade flighting 20 may cut the hole 95 in the ground 94 and displace the soil 96 (FIG. 20) into the housing interior 6 as the drive motor 88 continues to rotate the auger blade assembly 14. As illustrated in FIGS. 14 and 15, as the housing support frame 52 typically remains in the mixing position with the apparatus housing 2 in the lowermost position on the frame arms 56, soil amendments 92 may be poured from a suitable container 93 into the fill volume 8 (FIG. 8) above the auger blade flighting 20 in the housing interior 6. The rotating auger blade assembly 14 may mix the soil amendments 92 with the displaced soil 96 from the ground 94.

As the auger blade assembly 14 cuts the hole 95 in the ground 94, the housing support frame 52 may descend from the raised mixing position to the lowered digging position as the apparatus housing 2 typically remains stationary on the ground 94. Simultaneously, the depth gauge 24 may descend with the housing support frame 52. Accordingly, the position of the depth gauge terminus 25 with respect to the exterior surface of the housing wall 3 may be used to measure or estimate the depth of the hole 95 as it is cut in the ground 94. In some applications, the depth gauge terminus 25 on the depth gauge 24 may register with the depth markings to indicate the current depth of the hole 95 as the hole 95 is being formed in the ground 94. As further illustrated in FIG. 15, as the auger blade flighting 20 cuts the hole 95 in the ground 94, the soil amendments 92 may continue to be poured from a suitable container 93 into the fill volume 8 (FIG. 8) above the auger blade flighting 20 in the housing interior 6.

Figure 16:
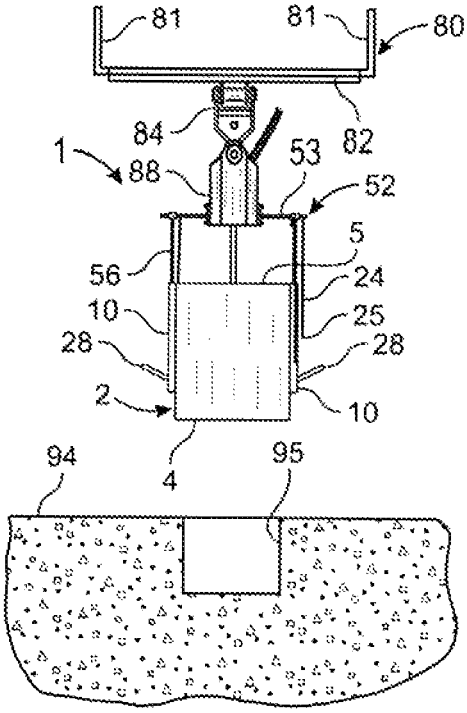

As illustrated in FIG. 16, after formation of the hole 95 in the ground 94 is completed, operation of the drive motor 88 may be suspended. The loader arms 81 of the utility vehicle 80 may be raised to lift the housing support frame 52 from the digging position to the mixing position as the arm receptacles 10 of the frame arms 56 of the housing support frame 52 extend from the respective arm receptacles 10 on the apparatus housing 2 and the apparatus housing 2 is suspended on the frame arms 56 above the hole 95. Most of the soil 96 which is removed from the ground 94 to form the hole 95, as well as the soil amendments 92 which were added from the container 93, may cling to the auger blade fighting 20 of the auger blade assembly 14 inside the housing interior 6 of the apparatus housing 2.

Figure 17:
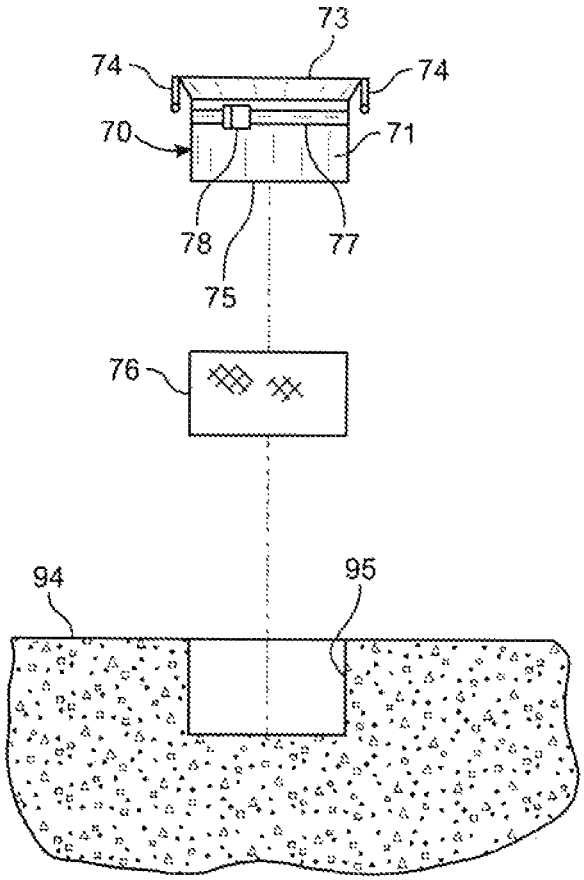
Figure 18:
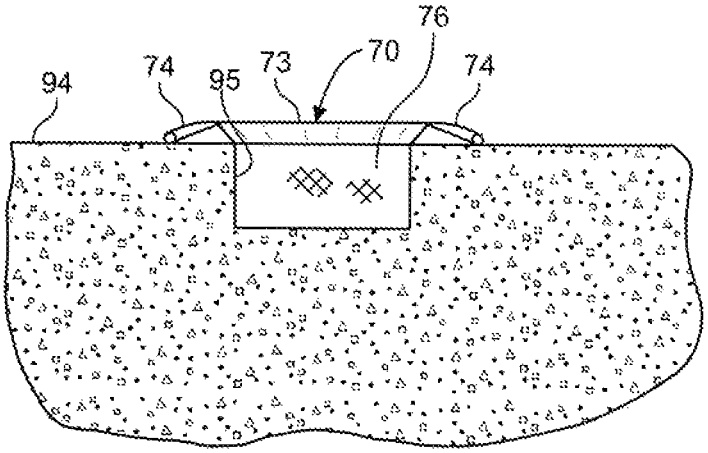

As illustrated in FIG. 17, the soil container 76 may next be deployed in place around the container sleeve wall 71 of the container sleeve 70. As illustrated in FIG. 18, the container sleeve 70 with the soil container 72 thereon may next be lowered into the hole 95 with the container sleeve flange 73 typically protruding above the surface of the ground 94.

Figure 19:
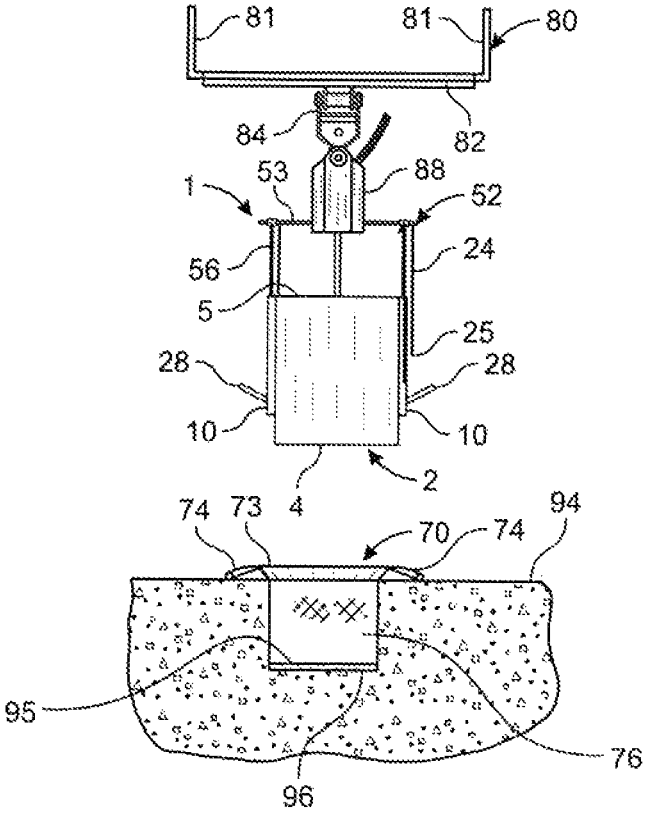

As illustrated in FIGS. 19 and 20, from the suspended state, the apparatus housing 2 of the apparatus 1 may next be lowered into place over the hole 95 with the container sleeve flange 73 on the container sleeve 70 encircling the apparatus housing 2 such that the apparatus housing 2 assumes a soil dropping or backfilling position. In FIG. 20, the soil dropping position, the auger blade assembly 14 may then be rotated in the opposite direction to backfill the hole 95 or dispense the displaced soil 96 with soil amendments 92 back into the hole 95. It will be appreciated by those skilled in the art that the typically conical shape of the container sleeve wall 71 may eliminate or substantially reduce spillage of soil from the container sleeve 70 upon backfilling. As illustrated in FIG. 21, the apparatus 1 may subsequently again be lifted from the container sleeve 70. The container sleeve 70 may then be removed from the soil container 76, which may remain in place in the hole 95. In some applications, the container sleeve handles 74 (FIG. 4) may be used to manually lift the container sleeve 70 from the soil container 76. In other applications, the sleeve handles 74 may be extended over the respective handle pegs or hooks 28 extending from the respective arm receptacles 10 on the apparatus housing 2. Accordingly, the sleeve handles 74 may pull or lift the container sleeve 70 from the soil container 76 as the soil container 76 remains in place in the hole 95. The tree or other vegetation 98 may then be planted in the displaced soil 96 in the hole 95, as illustrated in FIG. 22. It will be appreciated by those skilled in the art that the apparatus 1 eliminates the need for manual backfilling of the hole 95. This expedient may significantly reduce the installation cost of the soil container 76.

As illustrated in FIGS. 6-10, in some embodiments, at least one handle peg/hook 28 may extend outwardly from the apparatus housing 2. In some embodiments, a pair of the handle pegs 28 may extend from the apparatus housing 2, such as from the respective arm receptacles 10, for example and without limitation. Accordingly, in removal of the container sleeve 70 from the hole 95, as was heretofore described with respect to FIG. 21, the container sleeve handle or handles 74 (FIG. 4) may be extended over the respective handle peg pegs/hooks 28 such that the container sleeve 70 is removed from the hole 95 as the loader arms 81 on the utility vehicle 80 are operated to lift the apparatus 1 from the container sleeve flange 73 of the container sleeve 70, as was heretofore described.

Referring again to FIG. 10 of the drawings, it will be appreciated by those skilled in the art that the blade clearance space 66 between the outer blade edge 32 of the auger blade flighting 20 and the interior wall surface 7 of the housing wall 3 may be 3/16"-1/2" to facilitate optimum rotation of the auger blade flighting 20 in the housing interior 6 and mixing of the soil amendments 92 with the displaced soil 96 in the apparatus housing 2, as was heretofore described with respect to FIG. 20. Accordingly, the difference in widths or diameters between the outer blade edge 32 of the auger blade flighting 20 and the interior wall surface 7 of the housing wall 3 may be 3/8"-1". It has been found that a blade clearance space 66 which is less than 3/16" tends to cause excessive friction and consequent auger blade jamming or hindering of blade rotation, whereas a blade clearance space 66 of greater than 1/2" tends to cause irregular accumulation of displaced soil 96 between the auger blade flighting 20 and the housing wall and/or unacceptable quantities of the displaced soil 96 to fall from the housing interior 6 upon lifting the apparatus 1 from the ground 94 following formation of the hole 95, as was heretofore described with respect to FIG. 16, and/or during mixing of the soil amendments 92 with the displaced soil 96, as was heretofore described with respect to FIG. 20. Factors which may alter and determine the tendency of the soil to adhere to the auger blade flighting 20 or fall through the blade clearance space 66 include soil texture, soil type and soil moisture.

Referring again to FIG. 8, it will be further appreciated by those skilled in the art that the apparatus housing 2 may a housing length 12 of from about 30" to about 40", and optimally, about 36". A housing length 12 within this range renders ease to an operator of the apparatus 1 in viewing the housing interior 6 and pouring the soil amendments 92 into the fill volume 8 (FIG. 8) preparatory to and during mixing of the soil amendments 92 with the displaced soil 96 (FIG. 20). The apparatus housing 2 can be fabricated in different widths and diameters to facilitate augering holes 95 of corresponding widths or diameters for various purposes. For example and without limitation, exemplary widths or diameters for the apparatus housing 2 may include 10", 12", 16", 18", 24", 30", 36", 48", 60", 72", or 84". In other embodiments, the apparatus housing 2 may have smaller or larger widths or diameters.

It will be appreciated by those skilled in the art that the apparatus 1 is useful in a variety of applications including but not limited to planting of vegetation, as was heretofore described. For example and without limitation, the apparatus 1 may be useful as a construction tool, aiding in all types of pole installations. The apparatus 1 solves the main reason why plant growers choose not to use fabric containers or growbags due to high upfront installation costs. The apparatus 1 is among the safest, simplest and most cost-effective bag installing machines available. The apparatus 1 provides the capability to incorporate or amend soil through lime, fertilizer, organic matter, mycorrhiza, moisture retention agents, pesticides, etc. Furthermore, the apparatus 1 aerates the soil during bag installation while mixing the soil to provide a uniform texture.

The apparatus 1 is capable of operating on most farm topography including flat or uneven ground and slopes and many soils such as sandy, loamy, clay, rocky and sticky soils to include dry), moist, and wet conditions. The apparatus 1 is capable of operating consistently without regular adjustments on extremely-low maintenance. The apparatus 1 can easily accommodate multiple sizes with quick setup and change-over between sizes. The apparatus 1 can easily be retrofitted to skid steer augers in many cases.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. An in-ground container installation apparatus, comprising:

a housing support frame;

an apparatus housing having a housing interior resiliently carried by the housing support frame in a plumb and pendulum configuration, the housing support frame mounted for axial displacement between a mixing position and a digging position with respect to the apparatus housing when the apparatus housing is in a stationary position;

a drive motor carried by the housing support frame;

an auger blade assembly drivingly engaged for rotation by the drive motor, the auger blade assembly disposed in the housing interior in the mixing position of the housing support frame and extending from the apparatus housing in the digging position of the housing support frame;

wherein the auger blade assembly comprises a blade drive shaft drivingly engaged by the drive motor and an auger blade fighting extending from the blade drive shaft; and a blade clearance space between the auger blade fighting and the apparatus housing, the blade clearance space having a width of from 3/16" to 1/2".

2. The apparatus of claim 1 wherein the housing support frame comprises a main frame member and at least one frame arm carried by the main frame member, and wherein the apparatus housing is carried by the at least one frame arm.

3. The apparatus of claim 2 further comprising at least one arm receptacle carried by the apparatus housing, and wherein the at least one frame arm is telescopically inserted in the at least one arm receptacle.

4. The apparatus of claim 2 wherein the drive motor is carried by the main frame member of the housing support frame.

5. The apparatus of claim 1 further comprising at least one housing suspension member carried by the housing support frame and attached to the apparatus housing.

6. The apparatus of claim 1 further comprising a pilot extension extending from the blade drive shaft distal to the auger blade flighting.

7. The apparatus of claim 6 wherein the pilot extension comprises an elongated pilot extension shaft coupled to the blade drive shaft, a pilot extension tip terminating the pilot extension shaft and at least one pilot extension blade extending from the blade drive shaft.

8. The apparatus of claim 1 further comprising at least one depth gauge carried by the housing support frame.

9. The apparatus of claim 1 further comprising at least one handle peg carried by the housing support frame.

10. An in-ground container installation apparatus, comprising:

a housing support frame including:

a main frame member;

a pair of elongated, parallel, spaced-apart frame arms carried by the main frame member;

an apparatus housing resiliently carried by the housing support frame in a plumb and pendulum configuration, the apparatus housing including:

a housing wall with a proximal wall end and a distal wall end;

a housing interior formed by the housing wall between the proximal wall end and the distal wall end, the housing wall having an interior wall surface facing the housing interior and the housing support frame mounted for axial displacement between a mixing position and a digging position with respect to the apparatus housing when the apparatus housing is in a stationary position; and a pair of arm receptacles carried by the apparatus housing and telescopically receiving the frame arms of the housing support frame;

a drive motor carried by the apparatus housing; and an auger blade assembly disposed in the housing interior in the mixing position of the housing support frame and extending from the apparatus housing in the digging position of the housing support frame, the auger blade assembly including:

a blade drive shaft drivingly engaged for rotation by the drive motor; and an auger blade fighting extending from the blade drive shaft, the auger blade flighting having a blade edge; and a blade clearance space between the interior wall surface of the housing wall and the blade edge of the auger blade flighting.

11. The apparatus of claim 10 wherein the blade clearance space has a width of from 3/16" to 1/2".

12. The apparatus of claim 10 wherein the housing interior comprises a fill volume between the auger blade flighting and the proximal wall end of the housing wall in the mixing position of the housing support frame.

13. The apparatus of claim 10 further comprising at least one depth gauge carried by the housing support frame.

14. The apparatus of claim 10 further comprising a pair of housing suspension members carried by the housing support frame and attached to the apparatus housing.

15. The apparatus of claim 10 further comprising a pilot extension extending from the blade drive shaft distal to the auger blade flighting.

16. The apparatus of claim 15 wherein the pilot extension comprises an elongated pilot extension shaft coupled to the blade drive shaft, a pilot extension tip terminating the pilot extension shaft and at least one pilot extension blade extending from the blade drive shaft.

* * * * *